US005813240A

United States Patent [19]

Sato et al.

[11] Patent Number: 5,813,240

[45] Date of Patent: Sep. 29, 1998

[54] METHOD FOR CONSTRUCTING A REFRIGERATING CYCLE INCLUDING A PROCESS OF REMOVING OXYGEN

[75] Inventors: Shigehiro Sato, Osaka; Katsuya Wakita, Nara; Yusuke Ozaki, Toyonaka; Keizo Nakajima, Kawachinagano; Nobuo Sonoda, Settsu; Tetsuji Kawakami, Katano, all of Japan

[73] Assignee: Matsushita Electric Industrial Co., Ltd., Osaka, Japan

[21] Appl. No.: 937,440

[22] Filed: Sep. 25, 1997

Related U.S. Application Data

[63] Continuation of Ser. No. 748,351, Nov. 14, 1996, abandoned.

[30] Foreign Application Priority Data

Nov. 14, 1995 [JP] Japan ..... 7-295063
Mar. 1, 1996 [JP] Japan ..... 8-043932

[51] Int. Cl.[6] ..... F25B 47/00

[52] U.S. Cl. ..... 62/85; 62/303; 62/475

[58] Field of Search ..... 62/77, 85, 195, 62/149, 292, 303, 474, 475

[56] References Cited

U.S. PATENT DOCUMENTS 4,304,102 12/1981 Gray ..... 62/85
5,036,675 8/1991 Anderson, Jr. ..... 62/292

FOREIGN PATENT DOCUMENTS 3-70953 3/1991 Japan .
7-159004 6/1995 Japan .
7-269994 10/1995 Japan .

*Primary Examiner*—John M. Sollecito
*Attorney, Agent, or Firm*—Ratner & Prestia

[57] ABSTRACT

A method for constructing a refrigerating cycle that has a unit having a refrigerating compressor which is filled with a part or all of a quantity of working medium beforehand and a heat exchanger, and a unit having a heat exchanger that is located in an area of air conditioning and refrigeration, wherein the units are connected with each other by piping, uses such steps of: connecting the unit having the refrigerating compressor and heat exchanger with the unit having the heat exchanger that is located in an area of air conditioning and refrigeration by means of piping; removing oxygen in a system of the refrigerating cycle by providing an oxygen absorbent in a course of a refrigerant circulating path; separating the oxygen absorbent from the refrigerating cycle; and circulating a refrigerant in the refrigerating cycle, wherein the separating step is carried out immediately after or after the removing step, and the refrigerant circulating step is a final step.

26 Claims, 2 Drawing Sheets

METHOD FOR CONSTRUCTING A REFRIGERATING CYCLE INCLUDING A PROCESS OF REMOVING OXYGEN

This application is a continuation of application Ser. No. 08/748,351 filed Nov. 14, 1996, now abandoned.

BACKGROUND OF THE INVENTION

1. Field of the Invention

The present invention relates to a method for constructing a refrigerating cycle that comprises an indoor unit with hydrochlorofluorocarbon and hydrofluorocarbon used therein and an outdoor unit which is connected with the indoor unit by using connecting piping.

2. Related Art of the Invention

A refrigerating cycle used in an air conditioning apparatus consists of a mechanical part and fluid. The mechanical part comprises an outdoor unit which has a refrigerating compressor and a heat exchanger and an indoor unit which is provided with a heat exchanger in an area of the air conditioning and refrigeration and connected with the outdoor unit by such piping as a copper pipe. The fluid is-such as refrigerant and lubricating oil composition contained in the system. In such refrigerating cycle, the outdoor unit is filled with a part or all of refrigerant and a lubricating oil composition beforehand. Then, the refrigerating cycle is formed by connecting the outdoor unit with the indoor unit by means of connecting piping during a construction process. By simply connecting them with a pipe, however, the air is left over in the indoor heat exchanger within the indoor unit and the connecting piping. The residual air in the indoor unit must be removed, because it causes reduction in refrigerating capacity as a non-condensable gas, and the oxygen and water promote reduction in quality of materials in the refrigerating cycle.

As a first method for removing the air, a refrigerating cycle is formed by opening a separation valve, after the air in the indoor unit and the piping is removed by a vacuum pump, and connecting the indoor unit and outdoor unit.

As a second method, gases in the piping is more simply replaced by transferring a refrigerant in the outdoor unit to the piping and indoor unit during the construction process, and releasing the refrigerant containing the air to the atmosphere.

As a third method, that disclosed in Japanese Laid-open Patent. No. 7-159004 is known for removing the residual air in the refrigerating circuit. According to the method, a substance capable of absorbing two or more such gases as water, oxygen, nitrogen and carbon oxide is contained in a sealed manner within a part of the refrigerating cycle.

A method of employing an oxygen absorbent disclosed in Japanese Laid-open Patents Nos. 7-269994, 3-70953 and 7-159004 is known as a fourth method.

In the case of the first method of removing the air from the indoor unit and piping that provides a flow passage for a working medium by means of a vacuum pump, a power supply for the vacuum pump is required at the construction site, and cannot be regarded as a convenient method for use at any time.

The second method of replacing the air in the indoor unit and a flow channel for a working medium with a refrigerant is disadvantageous in terms of global environment due to a problem of destroying the ozone layer, because the refrigerant that cannot help being discharged to the atmosphere.

In the third method of sealing a substance that is capable of absorbing two or more such gases as water, oxygen, nitrogen and carbon oxide within a part of the refrigerating cycle, the absorbing substance contained in a sealed manner within the refrigerating cycle may adversely affect the refrigerant, refrigerating lubricant and the like.

Also, in the fourth method of employing an oxygen absorbent in a refrigerating cycle, the oxygen absorbent is always in contact with the refrigerant and refrigerating lubricant, and it is a problem that the refrigerant and refrigerating lubricant are adversely affected. Specifically, it has been a problem that-iron reacts to a refrigerating lubricant at a high temperature (150° C.), and forms an organic acid iron salt, which leads to clogging of capillary.

SUMMARY OF THE INVENTION

In consideration of such conventional construction method, it is an object of the invention to provide a simple and environment-friendly construction method capable of preventing entrance of oxygen into the refrigerating cycle.

A method of the first present invention for constructing a refrigerating cycle that has a unit having a refrigerating compressor which is filled with a part or all of a quantity of working medium beforehand and a heat exchanger, and a unit having a heat exchanger that is located in an area of air conditioning and refrigeration, wherein the units are connected with each other by piping, comprises such steps of:

connecting the unit having the refrigerating compressor and heat exchanger with the unit having the heat exchanger that is located in an area of air conditioning and refrigeration by means of piping;

removing oxygen in a system of the refrigerating cycle by providing an oxygen absorbent in a course of a refrigerant circulating path;

separating the oxygen absorbent from the refrigerating cycle; and circulating a refrigerant in the refrigerating cycle, wherein the separating step is carried out immediately after or after the removing step, and the refrigerant circulating step is a final step.

A method according to the first present invention is that the connecting, removing, separating and refrigerant circulating steps are carried out in this order.

A method according to the first present invention is that the removing, separating, connecting and refrigerant circulating steps are carried out in this order.

A method according to the first present invention is that the removing, connecting, separating and refrigerant circulating steps are carried out in this order.

A method of the second present invention for constructing a refrigerating cycle that has a unit having a refrigerating compressor which is filled with a part or all of a quantity of working medium beforehand, and a unit having a heat exchanger that is located in an area of air conditioning and refrigeration, wherein the units are connected by piping, comprises such steps of:

connecting the unit having the refrigerating compressor and heat exchanger with the unit having the heat exchanger that is located in an area of air conditioning and refrigeration by piping;

substituting oxygen for gases within the unit having the heat exchanger that is located in an area of air conditioning and refrigeration and/or the piping:

removing the oxygen in the refrigerating cycle by providing an oxygen absorbent in the course of a refrigerant circulating path;

separating the oxygen absorbent from the refrigerating cycle; and circulating refrigerant in the refrigerating cycle, wherein the removing step is carried out after the oxygen substituting step, the separating step is carried out immediately after or after the removing step, and the refrigerant circulating step is a final step.

A method according to the second present invention is that the connecting, oxygen substituting, removing, separating and refrigerant circulating steps are carried out in this order.

A method according to the second present invention is that the oxygen substituting, removing, separating, connecting and refrigerant circulating steps are carried out in his order.

A method according to the second present invention is that the oxygen substituting, removing, connecting, separating and refrigerant circulating steps are carried out in this order.

A method of the third present invention is such invention according to any one of the above inventions and is that the, oxygen absorbent is metallic powders, and serves for removing oxygen in the refrigerating cycle by solidifying the oxygen into metal oxides.

A method according to the third present invention is that the metallic powders are reduced iron powders.

A method according to any one of the present inventions is that the oxygen absorbent is a mixture of reduced iron powders and a metal chloride.

A method according to the above invention is that the metal chloride is iron chloride.

A method according to any one of the present inventions is that the oxygen absorbent is a mixture containing reduced iron powders, metal chloride, metal hydroxide and water.

A method according to any one is that the oxygen absorbent is a compound containing a metal sulfite.

A method according to the present invention is that in the removing step, the oxygen absorbent comes into contact with a part in the refrigerating cycle the part of which is filled with air or oxigen.

PREFERRED EMBODIMENTS OF THE INVENTION

Figure 1:
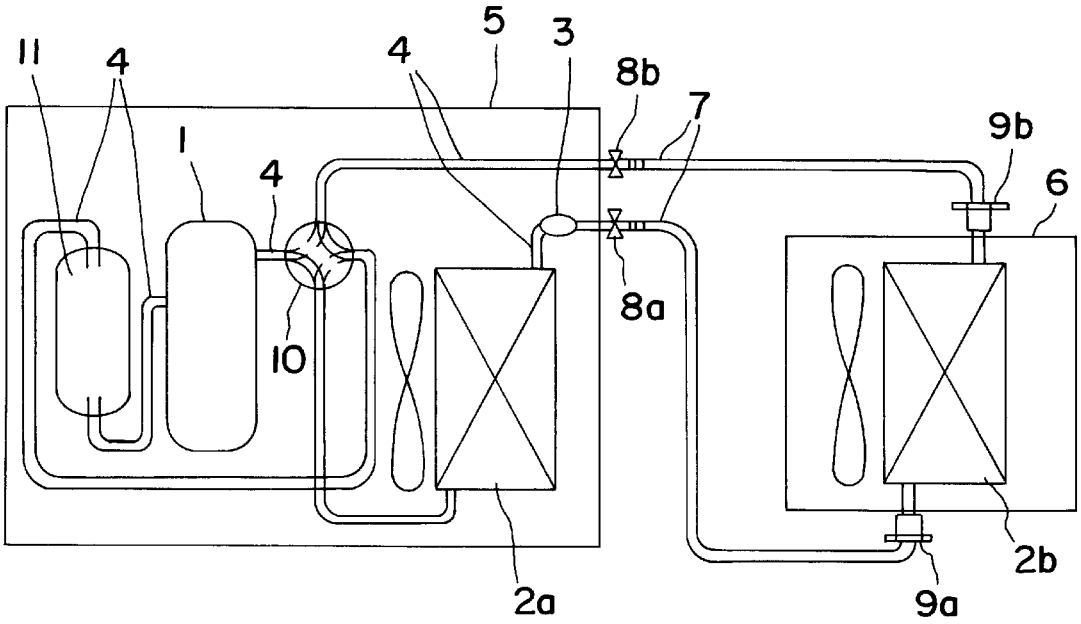
FIG. 1 is an overall layout of a refrigerating cycle according to an embodiment of the invention.

Embodiments of the invention are described below by referring to the drawings.

First, a refrigerating cycle to which the invention is applied is described in connection with the drawings. FIG. 1 is a schematic view of a refrigerating cycle to which an embodiment of the invention is applied, and the refrigerating cycle is formed by connecting an outdoor unit 5 having a refrigerating compressor 1, heat exchanger 2*a*, such member 3 for regulating the flow rate of a refrigerant as capillary tube or expansion valve and piping 4 for connecting them with an indoor unit 6 having a heat exchanger 2*b* that is located in an area of air conditioning and refrigeration by means of a connecting pipe 7, valves 8*a*, 8*b* and flare nuts 9*a*, 9*b*. In this case, because a four-way valve is provided, the heat exchangers 2*a*, 2*b* can alternately serve for condensation or evaporation. An accumulator 11 is also-provided.

As for a flow of refrigerant, in the case of cooling operation, the refrigerant condensed by the refrigerating compressor 1 is deprived of heat and liquefied at the heat exchanger 2*a* by removal of heat, takes the form of a cold vapor-liquid refrigerant by passing through the refrigerant flow rate regulating member 3, vaporized to a dry saturated vapor by absorbing heat at the heat exchanger 2*b* within the indoor unit 5, and sucked into the refrigerating compressor again, and this cycle is repeated. When the flow passage is changed by rotation of the four-way valve 10, the refrigerant is condensed at the heat exchanger 2*b*, and evaporated at the heat exchanger 2*a* for heating operation.

A construction method according to an embodiment of the invention is now described. Specifically, a method of constructing a refrigerating system for air conditioning comprising steps of connecting an outdoor unit, which has a refrigerating compressor and a heat exchanger, with an indoor unit having a heat exchanger that is located in an area of air conditioning and refrigeration by means of piping for passing a working medium, then removing the air in the refrigerating cycle by employing an oxygen absorbent in a part of the refrigerating cycle is outlined.

Figure 2:
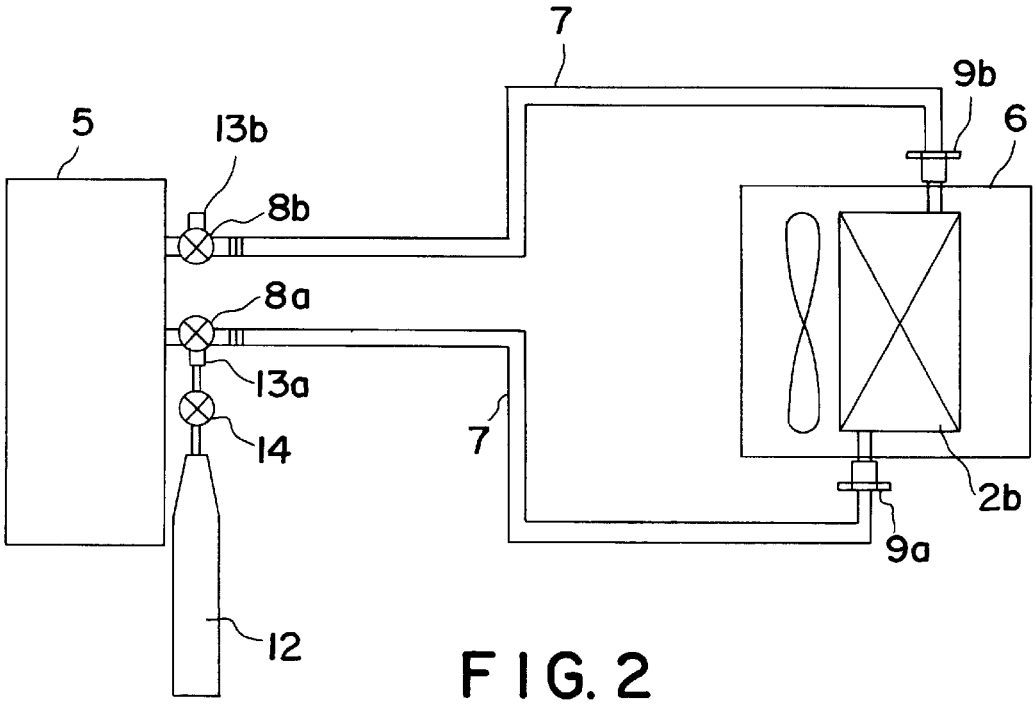
FIG. 2 is a layout when a container filled with an oxygen absorbent in a sealed manner is connected to a refrigerating cycle according to an embodiment of the invention during the construction process of the refrigerating cycle.

In FIG. 2, a method of constructing a refrigerating system for air conditioning that comprises an outdoor unit 5 and indoor unit 6 connected with each other by means of piping for passing a working medium is shown, wherein the outdoor unit 5 and indoor unit 6 are joined by a connecting pipe 7, valves 8*a*, 8*b* and flare nuts 9*a*, 9*b*. The valves 8*a*, 8*b* for coupling the outdoor flow passage of working medium to the piping for passing the working medium have ports 13*a*, 13*b* for removing the air by a vacuum pump and adding the refrigerant in addition to a connecting port with the piping for passing the working medium. A container 12 filled with an oxygen absorbent in a sealed manner is connected to the port 13*a*. It is preferable that the container 12 with the oxygen absorbent is removed as soon as the oxygen is removed, because it is useless once the oxygen is removed from the cycle before operation, and the oxygen absorbent may react to the refrigerant and refrigerating lubricant due to a high reducing property.

A valve 14 is provided in the container 12 to protect the oxygen absorbent against contact with oxygen while it is not used. The valve 8*a* is operated, while the valve 14 is kept in a closed state, so that the container 12, indoor unit 6 and connecting pipe 7 are brought into communication with one another. In this operation, the valve 8*b* is closed, and the outdoor unit 5 is separated from the indoor unit 6. The construction method can be achieved by successively opening the valve 14 of container 12 so that the oxygen absorbent comes in contact with the air in the indoor unit, 6 and piping 7, closing the valve 14 of the container 12 after a certain period of time, and removing the container 12 filled with the oxygen absorbent.

Figure 3A:
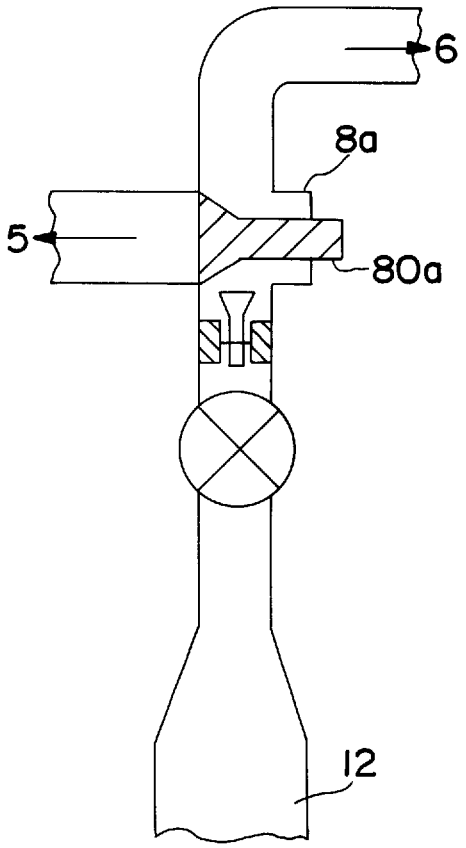
FIGS. 3(*a*),(*b*) show the details of the valve 8*a*.
Figure 3B:
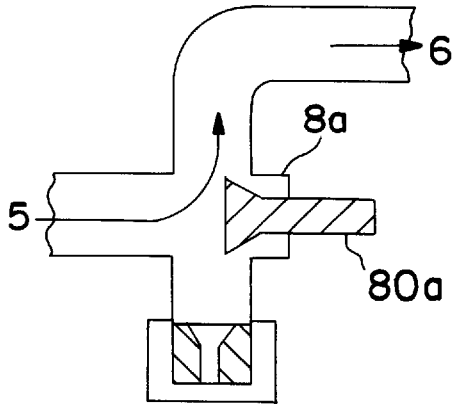

FIG. 3 shows the details of the valve 8*a* of the oxygen absorbing state (a) and the refrigerating state (b). In the state (a) the container 12 is connected to the indoor unit 6, and In the state (b) the indoor unit 6 is connected to the outdoor unit 5.

Known substances may be employed as an oxygen absorbent. Although such metallic powders as iron powders, such polyhydric phenols as hydroquinone and pyrogallol, and ascorbic acid, sulfite and and unsaturated fatty acid are practically applicable as an oxygen absorbent, such inorganic oxygen absorbent as iron powders, other metallic powders and sulfite is the most suitable because of high absorbing rate of oxygen. A substance for enhancing the activity of such oxygen absorbents and that for absorbing gases generated by oxygen absorbing reaction may be also contained simultaneously.

Although an oxygen absorbent is contained in the container 12, it is required to sufficiently activate such absorbent before use. For some types of oxygen absorbent, a certain time or external stimulus is required before it is activated, and provides a high oxygen adsorbing property. A quantity of oxygen absorbent to be contained can be determined according to a quantity of air to be removed from the portion.

It is preferred to adopt a method of increasing a partial pressure of oxygen in the system by filling the indoor unit with oxygen beforehand, because such method is effective for rapidly removing the oxygen in the indoor unit. As a method for filling the indoor unit with oxygen, that of filling it with oxygen at the plant before shipment and that of filling the indoor unit and piping with oxygen at the construction site are included.

As for a form of oxygen absorbent, porous granules or an oxygen absorbing sheet with an oxygen absorbent embedded in a resin is preferred, since a surface area of oxygen absorbing substance is increased.

Although the container 12 filled with the oxygen absorbent is connected to the valve 8*a* in FIG. 2, it may be connected to the valve 8*b*. Also, the refrigerant may be added to the refrigerating cycle before the container 12 is connected.

The invention is now described by way of specific embodiments.

[Embodiment 1]

An outdoor unit having a refrigerating compressor, heat exchanger and capillary tube and an indoor unit with a heat exchanger that is located in an area of air conditioning and refrigeration were fixed to respective installation positions. Then, a copper pipe was used for providing a refrigerant channel between them. The connecting pipes were connected with each other by means of valves and nuts, and a refrigerating system shown in FIG. 1 was formed. In this case, the outdoor unit 5 was filled with an HFC refrigerant in a sealed-manner, and the compressor in the outdoor unit with an ester refrigerating lubricant beforehand. Meanwhile, the indoor unit 6 was filled with air, and had a capacity of about 1000 $cm^3$.

A container 12 for containing reduced iron powders was prepared in the following manner. The reduced iron powders (made by Wako Pure Chemical Industries) of 100 g were placed in a stainless steel container of 100 $cm^3$ in capacity in an atmosphere of nitrogen, then a ball valve 14 was attached to an outlet of the container, and the container filled with the reduced iron powders was removed with the valve 14 in a closed position from the nitrogen atmosphere. The container 12 filled with the reduced iron powders was then connected to aport 13*a* in the valve 8*a*, as shown in FIG. 2. The valve 14 of container 12 with the reduced iron powders was opened so that the iron powders are exposed to the refrigerant channel. After 30 min of exposure, the valve 14 of container 12 was closed, and the container filled with the reduced iron powders was removed from the refrigerant channel.

Although the refrigerating lubricant was removed after 3000 hrs. of continuous operation, no change in appearance of the refrigerating lubricant was observed, and a total acid number of the refrigerating lubricant was at 0.02 mg KOH/g, which was almost unchanged from a value (0.01 mg KOH/g) at the beginning of operation, It is recognized from the measured value that almost no acid was produced. In other words, it was recognized that almost no reduction in quality due to oxidization of refrigerating lubricant was caused.

[Embodiment 2]

An outdoor unit having a-refrigerating compressor, heat exchanger and capillary tube and an indoor unit having a heat exchanger that is located in an area of the air conditioning and refrigeration were fixed to respective installation positions. Then, a copper pipe was used for providing a refrigerant channel between them. The connecting pipes were connected with each other by service valves and flare nuts, and a refrigerating system similar to that of Embodiment 1 was formed. In this case, the outdoor unit 5 was filled with an HFC refrigerant, and the compressor in the outdoor unit 5 with an ester refrigerating lubricant beforehand. Meanwhile, the indoor unit 6 was filled with air, and had a capacity of about 1000 $cm^3$.

A container 12 for containing reduced iron powders and ferric chloride was prepared in the following manner First, reduced iron powders (made by Wako Pure Chemical Industries) of 100 g, then ferric chloride (anhydrous, made by Wako Pure Chemical Industries) of 5 g were placed in a stainless steel container of 100 $cm^3$ in capacity in an atmosphere of nitrogen. A ball valve 14 was attached to an outlet of the container, and the container 12 filled with the reduced iron powders and ferric chloride was removed with the valve 14 in a closed position from the nitrogen atmosphere. The container 12 filled with the reduced iron powders and ferric chloride was connected to a port 8*a*, as shown in FIG. 2. Then, after the valve 8*a* was opened for establishing communication between the indoor unit 6 and outdoor unit 5, the valve 14 of container 12 filled with the reduced iron powders and ferric chloride was opened, and the reduced iron powders and ferric chloride were exposed to the refrigerant channel. After 10 min of exposure, the valve 14 was closed, and the container 12 with the reduced iron powders and ferric chloride was removed from the refrigerant channel.

Although the refrigerating lubricant was removed after 3000 hrs. of continuous operation, no change in appearance of the refrigerating lubricant was observed, and a total acid number of the refrigerating lubricant was at 0.01 mg KOH/g, which was unchanged from a value (0.01 mg KOH/g) at the beginning of operation. It is recognized from the measured value that almost no acid was produced. In other words, it was recognized that almost no reduction in quality due to oxidization of the refrigerating lubricant was caused.

[Embodiment 3]

An outdoor unit having a refrigerating compressor, heat exchanger and capillary tube and an indoor unit having a heat exchanger that is located in an area of the air conditioning and refrigeration were fixed to respective installation positions. A copper pipe was used for providing a refrigerant channel between them. The connecting pipes were connected with each other by means of valves and flare nuts, and a refrigerating system shown in FIG. 1 was formed. In this case, the outdoor unit 5 was filled with an HFC refrigerant, and the compressor in the outdoor unit 5 with an ester refrigerating lubricant beforehand. Meanwhile, the indoor unit 6 was filled with air, and had a capacity of about 1000 $cm^3$.

An oxygen gas was supplied from one through the other sides so that the indoor unit 6 was filled with the oxygen gas.

A container for containing reduced iron powders was prepared in the following manner. Reduced iron powders (made by Wako Pure Chemical Industries) of 100 g were placed in a stainless steel container of 100 $cm^3$ in capacity in an atmosphere of nitrogen, then a ball valve 14 was attached to an outlet of the container, and the container filled with the reduced iron powders was removed with the valve in a closed position from the nitrogen atmosphere. The container 12 filled with the reduced iron powders was connected to an open port 13*a* of valve 8*a*, as shown in FIG. 2. Then, after the valve 8*a* is opened for establishing communication between the indoor unit 6 and outdoor unit 5, the valve 14 of container 12 with the reduced iron powders was opened, and the reduced iron powders were exposed to the refrigerant channel. After 30 min of exposure, the valve 14 was closed, and the container with the reduced iron powders was removed from the refrigerant channel.

Although the refrigerating lubricant was removed after 3000 hrs. of continuous operation, no change in appearance of the refrigerating lubricant was observed, and a total acid number of the refrigerating lubricant was at 0.01 mg KOH/g, which was almost-unchanged from a value (0.01 mg KOH/g) at the beginning of operation. It is recognized from the measured value that almost no acid was produced. In other words, it was recognized that almost no reduction in quality due to oxidization of the refrigerating was caused.

[Embodiment 4]

An outdoor unit having a refrigerating compressor, heat exchanger and capillary tube and an indoor unit having a heat exchanger 2*b* that is located in an area of the air conditioning and refrigeration were fixed to respective installation position. A copper pipe was used for providing a refrigerant channel between them. The connecting pipes were connected with each other by means of valves and flare nuts, and a refrigerating cycle system shown in FIG. 1 was formed. In this case, the outdoor unit 5 was filled with an HFC refrigerant and the compressor in the outdoor unit 5 with an ester refrigerating lubricant beforehand. Meanwhile, the indoor unit 6 was filled with air, and had a capacity of about 1000 $cm^3$.

A container for containing an oxygen absorbent that is provided by using a ferrous material was prepared in the following manner. Reduced iron powders (made by Wako Pure, Chemical Industries) of 100 g, sodium chloride (made by Kanto Chemical) of 2 g, potassium hydroxide (made by Kanto Chemical) of 1 g and water of 1 g were sufficiently mixed with each other, and heated to remove water, and an oxygen absorbent was prepared. The oxygen absorbent was then placed in a stainless steel container of 100 $cm^3$ in capacity, and a ball valve 14 was attached to an outlet of the container. The container 12 filled with the oxygen absorbent was connected to a port 13*a* in valve 8*a*, as shown in FIG. 2. Then, after the valve 8*a* was turned so for establishing communication between the indoor unit 6 and piping 7 and the container 12 with the oxygen absorbent, the valve 14 of container 12 filled with the oxygen absorbent was opened, and the oxygen absorbent was exposed to the air within the indoor unit 6 and piping. After 30 min of exposure, the valve 14 of container 12 was closed, the valve 8*a* was opened for allowing the refrigerant to flow in the outdoor unit 5, piping 7 and indoor unit 6, and the container 12 with the oxygen absorbent was removed.

Although the refrigerating lubricant was removed after 3000 hrs. of continuous-operation, no change in appearance of the refrigerating lubricant was observed, and a total acid value of the refrigerating lubricant was at 0.02 mg KOH/g, which was almost unchanged from a value (0.01 mg KOH/g) at the beginning of operation. It is recognized from the measured value that almost no acid was produced. In other words, it was recognized that almost no reduction in quality due to oxidization of the refrigerating lubricant was caused.

[Embodiment 5]

An oxygen absorbent was prepared in the following manner. That is an oxygen absorbent was prepared by mixing 20 g of sodium sulfite, 5 g of hydrate of iron sulfite, 1 g of potassium hydroxide and 5 g of water. The oxygen absorbent was placed in the stainless steel container used in Embodiment 4, and a refrigerating cycle was constructed in a manner similar to that of Embodiment 1.

Although the refrigerating lubricant was removed after 3000 hrs. of continuous operation, no reduction in quality of the refrigerating lubricant was observed, and a total acid number of the refrigerating lubricant was at 0.03 mg KOH/g, which was almost unchanged from a value (0.01 mg KOH/g) at the beginning of operation.

By constructing a refrigerating cycle in a manner similar to that of Embodiment 1 by using the oxygen absorbent that had been used twice, and removing the refrigerating lubricant after 3000 hrs. of continuous operation, no change in appearance of the refrigerating lubricant was observed, and a total acid number of the refrigerating lubricant was at 0.03 mg KOH/g, which was almost unchanged from a value (0.02 mg KOH/g) at the beginning of operation. It is recognized from the measured value that almost no acid was produced. In other words, it was recognized that almost no reduction in quality due to oxidization of the refrigerating lubricant was caused.

[Embodiment 6]

A two-way valve was attached to two piping outlets of a heat exchanger 26 that is located in an area of air conditioning and refrigeration, then after the heat exchanger located in an area of air conditioning and refrigeration was filled with oxygen supplied from a side of the valve, two valves were closed. In this case, the quantity of oxygen contained was about 1000 $cm^3$.

An outdoor unit having a refrigerating compressor, heat exchanger and capillary tube and an indoor unit having the heat exchanger 26 that is located in an area of air conditioning and refrigeration were fixed to respective installation positions. A copper pipe was used for providing a refrigerant channel between them. The connecting pipes were connected with each other by means of valves and flare nuts, and a refrigerating cycle shown in FIG. 1 was formed. In this case, the outdoor unit 5 was filled with an HFC refrigerant, and the compressor in the outdoor unit 5 with an ester refrigerating lubricant beforehand.

The container 12 filled with the oxygen absorbent that was prepared in Embodiment 4 was connected to an open port 13*a* of the three-way valve 8*a*. After the two-way valve of indoor unit 6 was opened, and the valve 8*a* is turned for establishing communication between the indoor unit 6 and piping 7 and the container 12 with the oxygen absorbent, the valve 14 of container 12 filled with the oxygen absorbent was opened, and the oxygen absorbent was exposed to oxygen and a low quantity of air in the indoor unit 6 and piping 7. After 30 min of exposure, the valve 14 was closed, then the valve 8*a* was opened for allowing the refrigerant to flow in the outdoor unit 5, piping 7 and indoor unit 6, and the container filled with the oxygen absorbent was removed.

Although the refrigerating lubricant was removed after 3000 hrs. of continuous operation, no change in appearance of the refrigerating lubricant was observed, and a total acid number of the refrigerating lubricant was at 0.01 mg KOH/g, which was almost unchanged from a value (0.01 mg KOH/g) at the beginning of operation. It is recognized from the measured value that almost no acid was produced. In other words, it was recognized that almost no reduction in quality due to oxidization of the refrigerating lubricant was caused.

[Comparison Example 1]

An outdoor unit having a refrigerating compressor, heat exchanger and capillary tube and an indoor unit having a heat exchanger that is located in an area of air conditioning and refrigeration were fixed to respective installation positions. A copper pipe was used for providing a refrigerant channel between them. The connecting pipes were connected with each other by means of valves and flare nuts, and a refrigerating cycle system similar to that of Embodiment 1 was formed. In this case, the outdoor unit 5 was filled with an HFC refrigerant, and the compressor in the outdoor unit 5 with an ester refrigerating lubricant beforehand. Meanwhile, the indoor unit 6 was filled with air, and had a capacity of about 1000 $cm^3$.

A valve 8*a* was opened for establishing communication between the indoor unit 6 and outdoor unit 5. When the refrigerating oil was removed after 3000 hrs. of continuous operation, the refrigerating oil was changed in color to yellow, and reduction in quality of the oil was enhanced. A total acid number was at 0.2 mg KOH/g, which was ten times higher than that of the embodiment, showing that reduction in quality was enhanced.

[Comparison Example 2]

A test sample was prepared by placing 1 g of iron powders similar to those used in Embodiment 1 and 2 g of an ester refrigerating lubricant formulated to have 1000 ppm of dissolved water in a sealed tube (in compliance with Appendix 2 of JIS K2211), and sealing the tube in vacuum. After the sample was heated at a temperature of 250° C. for 50 hrs., the appearance of sample was inspected, and a non-condensable gas in the tube was subjected to a quantitative analysis. The non-condensable gas was measured by gas chromatography. As a result, no change in color and no non-condensable gas was observed in a sample containing no iron powder, while a sample containing the iron powder was changed in color to reddish brown, and a non-condensable gas of 6.5 ml, when converted to atmospheric pressure, was produced. By adding 1 g of refrigerant (HFC401A) to 0.5 g of the sample that had been changed in color to reddish brown, and cooling it, an insoluble matter of reddish brown color was obtained. Thus, when iron powders were left in the refrigerating lubricant, the iron powders react to the refrigerating lubricant, and form a degradation product insoluble to the refrigerant. A non-condensable gas is also produced, which cannot be liquefied even by a compressor, leading to reduction in efficiency of the air conditioning apparatus.

Thus, the invention presents, easily and preferably for the environments, a method of installation capable of preventing mixture of oxygen that may promote deterioration of the refrigerating cycle, in particular, in the air into the refrigeration cycle.

In th foregoing embodiments, meanwhile, the container filled with oxygen absorbent is installed in the cock portion of the outdoor unit, but it may be installed in any other place as far as installed in a portion usually filled with air at the time of installation, that is, anywhere from the indoor unit to the piping.

What is claimed is:

1. A method for constructing a refrigerating cycle that has a first unit having a refrigerating compressor which is filled with a quantity of working medium and a first heat exchanger, and a second unit having a second heat exchanger that is located in an area of air conditioning and refrigeration, wherein the units are connected with each other by piping, the method comprising the steps of:

connecting the first unit having the refrigerating compressor and the first heat exchanger with the second unit having the second heat exchanger that is located in an area of air conditioning and refrigeration by means of piping;

removing oxygen in a system of the refrigerating cycle by providing an oxygen absorbent in a refrigerant circulating path;

separating the oxygen absorbent from the refrigerating cycle; and circulating a refrigerant in the refrigerating cycle.

2. A method for constructing a refrigerating cycle according to claim 1, wherein the connecting, removing, separating and refrigerant circulating steps are carried out successively.

3. A method for constructing a refrigerating cycle according to claim 1, wherein the removing, separating, connecting and refrigerant circulating steps are carried out successively.

4. A method for constructing a refrigerating cycle according to claim 1, wherein the removing, connecting, separating and refrigerant circulating steps are carried out successively.

5. A method for constructing a refrigerating cycle that has a first unit having a refrigerating compressor which is filled with a quantity of working medium and a first heat exchanger, and a second unit having a second heat exchanger that is located in an area of air conditioning and refrigeration, wherein the units are connected by piping, the method comprising the steps of:

connecting the first unit having the refrigerating compressor and the first heat exchanger with the second unit having the second heat exchanger that is located in an area of air conditioning and refrigeration by piping;

substituting oxygen for gases within the second unit having the first heat exchanger that is located in an area of air conditioning and refrigeration and the piping:

removing the oxygen in the refrigerating cycle by providing an oxygen absorbent in a refrigerant circulating path;

separating the oxygen absorbent from the refrigerating cycle; and circulating refrigerant in the refrigerating cycle.

6. A method for constructing a refrigerating cycle according to claim 5, wherein the connecting, oxygen substituting, removing, separating and refrigerant circulating steps are carried out successively.

7. A method for constructing a refrigerating cycle according to claim 5, wherein the oxygen substituting, removing, separating, connecting and refrigerant circulating steps are carried out successively.

8. A method for constructing a refrigerating cycle according to claim 5, wherein the oxygen substituting, removing, connecting, separating and refrigerant circulating steps are carried out successively.

9. A method for constructing a refrigerating cycle according to claim 1, wherein the oxygen absorbent is metallic powders, and removes oxygen in the refrigerating cycle by solidifying the oxygen into metal oxides.

10. A method for constructing a refrigerating cycle according to claim 5, wherein the oxygen absorbent is metallic powders, and removes oxygen in the refrigerating cycle by solidifying the oxygen into metal oxides.

11. A method for constructing a refrigerating cycle according to claim 9, wherein the metallic powders are reduced iron powders.

12. A method for constructing a refrigerating cycle according to claim 10, wherein the metallic powders are reduced iron powders.

13. A method for constructing a refrigerating cycle according to claim 1, wherein the oxygen absorbent is a mixture of reduced iron powders and a metal chloride.

14. A method for constructing a refrigerating cycle according to claim 5, wherein the oxygen absorbent is a mixture of reduced iron powders and a metal chloride.

15. A method for constructing a refrigerating cycle according to claim 13, wherein the metal chloride is iron chloride.

16. A method for constructing a refrigerating cycle according to claim 14, wherein the metal chloride is iron chloride.

17. A method for constructing a refrigerating cycle according to claim 1, wherein the oxygen absorbent is a mixture containing reduced iron powders, metal chloride, metal hydroxide and water.

18. A method for constructing a refrigerating cycle according to claim 5, wherein the oxygen absorbent is a mixture containing reduced iron powders, metal chloride, metal hydroxide and water.

19. A method for constructing a refrigerating cycle according to claim 1, wherein the oxygen absorbent is a compound containing a metal sulfite.

20. A method for constructing a refrigerating cycle according to claim 5, wherein the oxygen absorbent is a compound containing a metal sulfite.

21. A method for constructing a refrigerating cycle according to claim 1, wherein in the removing step, the oxygen absorbent comes into contact with a part in the refrigerating cycle the part of which is filled with air or oxigen.

22. A method for constructing a refrigerating cycle according to claim 5, wherein in the removing step, the oxygen absorbent comes into contact with a part in the refrigerating cycle the part of which is filled with air or oxigen.

23. A method for constructing a refrigerating cycle according to claim 1, wherein the separating step is carried out after the removing step, and the refrigerant circulating step is a final step.

24. A method for constructing a refrigerating cycle according to clam 1, wherein the separating step is carried out immediately after the removing step, and the refrigerant circulating step is a final step.

25. A method for constructing a refrigerating cycle according to claims 5, wherein the removing step is carried out after the oxygen substituting step, the separating step is carried out after the removing step, and the refrigerant circulating step is a final step.

26. A method for constructing a refrigerating cycle according to claim 5, wherein the removing step is carried out after the oxygen substituting step, the separating step is carried out immediately after the removing step, and the refrigerant circulating step is a final step.

* * * * *